United States Patent [19]

Bauer

[11] 4,392,584

[45] Jul. 12, 1983

[54] VENT CAP FOR A CONTAINER ACCOMMODATING HYDRAULIC FLUIDS

[75] Inventor: Ludwig Bauer, Stuttgart, Fed. Rep. of Germany

[73] Assignee: Daimler-Benz Aktiengesellschaft, Fed. Rep. of Germany

[21] Appl. No.: 202,413

[22] Filed: Oct. 30, 1980

[30] Foreign Application Priority Data

Oct. 30, 1979 [DE] Fed. Rep. of Germany ..... 2943747

[51] Int. Cl.[3] ..... B65D 51/16

[52] U.S. Cl. ..... 220/374; 220/373

[58] Field of Search ..... 220/366, 367, 371, 373, 220/374; 60/534, 535, 585, 592; 215/261, 364

[56] References Cited

U.S. PATENT DOCUMENTS

| | | | |
|---|---|---|---|
| 3,454,182 | 7/1969 | Morton | 220/374 |
| 3,454,183 | 7/1969 | Fuchs | 220/374 |
| 4,036,393 | 7/1977 | Neiman | 220/374 |
| 4,049,152 | 9/1977 | Treanor | 220/367 |
| 4,094,437 | 6/1978 | Hayashida | 220/374 |
| 4,130,222 | 12/1978 | Ono | 220/373 |

FOREIGN PATENT DOCUMENTS

| | | | |
|---|---|---|---|
| 1233681 | 2/1967 | Fed. Rep. of Germany | 220/374 |
| 1123301 | 9/1956 | France | 220/374 |

*Primary Examiner*—Joseph Man-Fu Moy
*Assistant Examiner*—Gary E. Elkins
*Attorney, Agent, or Firm*—Craig & Burns

[57] ABSTRACT

A vent cap for a container of housing which accommodates a hydraulic operating medium. The vent cap includes a housing type cover which has labyrinth walls. The cover is adapted to be closed by a base insert which includes a vent passage. The vent cap is adapted to be mounted on a vent opening of the container or housing. The housing type cover is rotatably mounted on the base insert.

36 Claims, 3 Drawing Figures

VENT CAP FOR A CONTAINER ACCOMMODATING HYDRAULIC FLUIDS

The present invention relates to a vent cap and, more particularly, to a vent cap for a container or housing which accommodates a hydraulic operating medium, with the vent cap having a housing type cover including labyrinth walls, which cover is closeable by a base insert having a vent passage, with the vent cap being adapted to be mounted on a vent opening of the container or housing.

A vent cap of the aforementioned type has been proposed wherein a cover and a base insert are made of a plastic material with the two parts being tightened non-rotatably together by a metal hexagonal insert. The base insert is provided with a gasket in order to protect a vent passage therein and the vent opening of the container or housing against a penetration of fluids or the like. A disadvantage of this proposed construction resides in the fact that, since the cover projects above an exterior wall of the container or housing in an operative position, there is a danger that the cover may accidentally or inadverently be loosened through an external intervention thereby resulting in the seal being broken and a leak occurring at the vent cap or cover.

The aim underlying the present invention essentially resides in providing a vent cap arrangement which protects the seal of the vent cap against any inadverent external action on the cover.

In accordance with advantageous features of the present invention, the housing type cover is rotatably mounted on the base insert of the vent cap.

Advantageously, the base insert is provided at the end opposite the cover with tongues having barbed tips, which tongues are made of a plastic material and are radially compressible with respect to an axis of the base.

The base insert may be provided with a circumferential groove located outside the cover, which groove serves to accept an annular seal.

In accordance with further advantageous features of the present invention, a bearing pin is provided which is coaxial with respect to the base axis with a hub of the base insert being rotatably mounted on the pin and also being firmly mounted in directions of the base axis.

The bearing pin of the present invention may advantageously include a passageway which connects both with a vent passageway and with a chamber in the cover which includes the labyrinth walls.

Additionally, the bearing pin may include tongues provided with tips, which tongues are compressible radially under a spring tension with respect to the base axis, with the tips cooperating with matching stops on the hub in order to enable an immobilization in an axial direction.

Advantageously, the vent passage recess may be located eccentrically with respect to the base axis and the base insert may be provided with a central opening for a metal threaded nut, which nut is non-rotatably mounted on the cover. Preferably, the nut is stationarily or non-movably mounted on the cover in the directions of the screw axis.

Moreover, in accordance with the present invention, the threaded nut may be provided at an end opposite the cover with a bearing pin for mounting a hub of the base insert. The hub of the base insert is preferably made of a plastic material and a free end of the bearing pin is provided with an annular bead.

The threaded nut of the vent cap of the present invention may be provided, at an end opposite the bearing pin, with a mounting pin, with the mounting pin engaging in a recess in the cover.

A receiving bore may be provided, with the receiving bore being located in a pin-shaped extension of the cover.

Advantageously, the threaded nut of the vent cap of the present invention has a central bead between the bearing pin and the mounting pin with the bead being non-rotatably mounted in a recess provided in the cover.

In accordance with still further features of the present invention, an end surface of the base insert located opposite the cover, has a shorter distance with respect to the cover in the directions of the base axis then does an end surface of the threaded nut which is located opposite the cover. Advantageously the end surface of the base insert located opposite the cover is provided with an annular groove concentric with respect to the base axis in order to accept of accommodate an annular seal.

Accordingly, it is an object of the present invention to provide a vent cap for containers or housings which contain hydraulic operating substances which avoids, by simple means, shortcomings and disadvantages encountered in the prior art.

Another object of the present invention resides in providing a vent cap for containers or housings accommodating hydraulic operating substances which prevent a breaking of the seal of the vent cap due to an inadverent external action on a cover of the vent cap.

Yet another object of the present invention resides in providing a vent cap for containers or housings accommodating hydraulic operating substances which is simple in construction and therefore relatively inexpensive to manufacture.

Yet another object of the present invention resides in providing a vent cap for containers or housings accommodating hydraulic operating substances which ensures the existence of an adequate seal under all conditions.

These and other objects, features, and advantages of the present invention will become more apparent from the following description when taken in connection with the accompanying drawings which show, for the purposes of illustration only, two embodiments in accordance with the present invention, and wherein.

Figure 1:
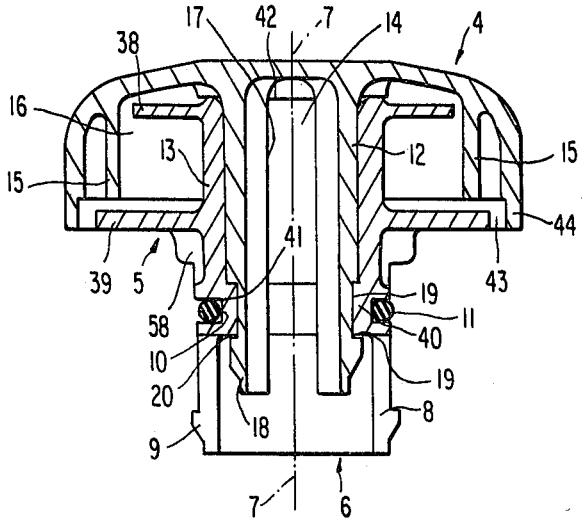
FIG. 1 is a cross sectional view taken along the axis of the base of a vent cap in accordance with a first embodiment of the present invention.

Referring now to the drawings wherein like reference numerals are used throughout the various views to designate like parts and, more particularly, to FIG. 1, according to this Figure, a cover generally designated by the reference numeral 4, in the form of a bell-shaped housing, includes labyrinth walls 15 and an inner central hollow bearing pin 12. A base insert generally designated by the reference numeral 5 includes a hub 13 rotatably mounted on the inner central hollow bearing pin 12 of the cover 4. The hub 13 of the base insert is provided with labyrinth walls 38, 39 and an inner bead 40 which extends radially inwardly with respect to a base axis 7, 7. The inner bead 40 is adapted to engage a circumferential groove 41 provided in the bearing pin 12. In this manner, radial boundary surfaces 19 of the circumferential groove 41 serve as stops and lateral limiting surfaces 20 of the bead 40 serve as stops for axial mounting of the hub 13 on the bearing pin 12.

The central opening of the hub 13 forms a vent passage 14, connected at the point 42 by elongated slots 17 of the bearing pin 12 with a labyrinth chamber 16. An annular slot 43 is disposed between a cover edge 44 and the labyrinth wall 39 so as to form a connection or communication between the labyrinth chamber 16 and the atmosphere.

Due to the longitudinal slots 17, free ends of the bearing pin 12 are made in the form of spring tongues 18, with the tongues 18 being tensioned together under a spring tension as they pass through the bead 40. An outer end of the hub 13, opposite the cover 4, is axially slotted so that spring tongues 8 are formed, with the tongues 8 having barbed tips 9 at their free ends. The barbed tips 9, together with tips 58 provided on the labyrinth wall 39, are utilized for the purposes of axial immobilization of the vent cap in the vent opening of the housing to be sealed such as, for example, a drive housing of an automatic transmission (not shown).

The hub 13 is provided with an external circumferential groove 10 between the tongues 8 and the labyrinth wall 39. The groove 10 is adapted to accommodate an annular seal 11. By virtue of the rotatable mounting of the cover 4 on the hub 13, any inadverent external influences on the cover 4 will have no effect on the sealing provided by the annular seal 11.

Figure 2:
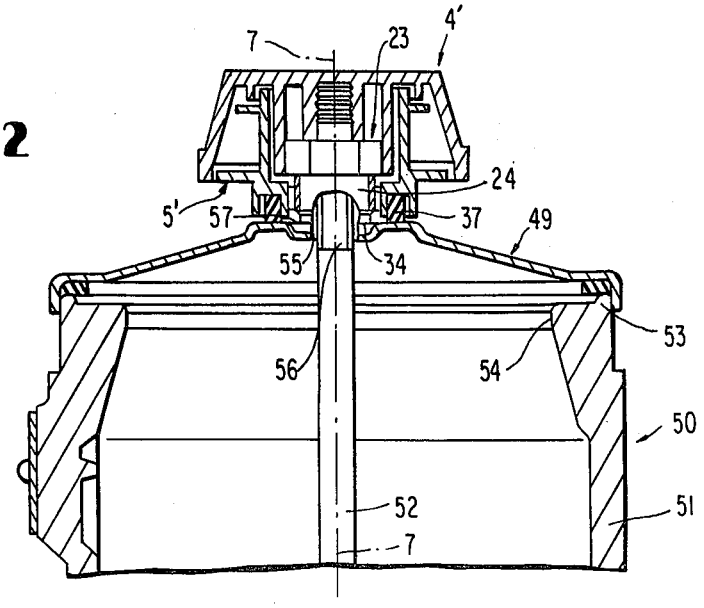
FIG. 2 is a cross sectional view of a vent cap in accordance with a second embodiment of the present invention arranged on an oil supply container of a power steering pump for a motor vehicle.

As shown in FIG. 2, a supply container generally designated by the reference numeral 50 is provided with a cover generally designated by the reference numeral 49. The supply container 50 may, for example, accommodate a pressure medium for a power steering unit (not shown). The cover 49 is tensioned by means of a vent cap more clearly depicted in the enlarged view of FIG. 3 and a stud bolt 52 on an upper edge 53 of a filling opening 54 of a container housing 51. The stud bolt 52, mounted on a bottom of the housing 51 in a manner not shown in detail is provided at its upper end with a threaded pin which passes or extends through a vent opening 55 provided in the cover 49 with play. The pin is threaded into an inside thread 48 (FIG. 3) of a bearing pin 24 of a threaded nut generally designated by the reference numeral 23. This arrangement causes an end surface 34 of the bearing pin 24 to abut a central tensioning surface 57 on the upper surface of the cover 49. Since as shown by the dimensional arrows designated 33, 35, the end surface 32 of a base insert generally designated by the reference numeral 5' is recessed with respect to the end surface 34, and the base insert 5 is rotatably mounted relative to a cover generally designated by the reference numeral 4' in a manner more fully described hereinbelow in connection with FIG. 3, an operating of the cover 4' does not have a harmful effect upon the seal 37.

Figure 3:
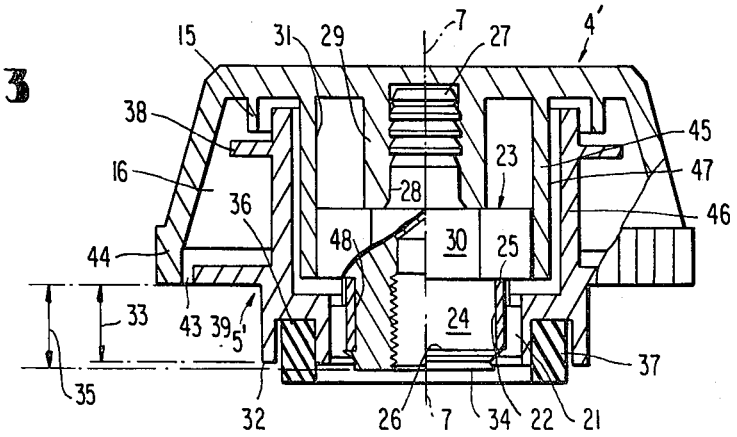
FIG. 3 is a cross sectional view, on an enlarged scale, of the vent cap of FIG. 2.

As shown in FIG. 3, the base insert 5' is provided, with a metal threaded nut 23 being rotatably mounted by a hub 25 thereof on a bearing pin 24. The cover 4' includes a tip 29 formed as a hollow pin and extending in a direction of the base axis 7—7. The threaded nut 23 is fixedly or stationarily mounted in the directions of the base axis 7—7 by means of a mounting pin 27 disposed opposite the nut 23. The mounting pin 27 is adapted to be accommodated in a cylindrical recess 28 of the tip 29.

A bead 30, in the form of a hexagon, is disposed in a central area of the threaded nut 23. The bead 30 is adapted to be non-rotatably inserted into a corresponding recess 31 provided in an extension 45 of the cover 4'.

The hub 25 is fixed or immobilized in the directions of the base axis 7—7 with respect to the threaded nut 23 on the one hand by the bead 30 and, on the other hand, by a small annular bead 26 provided on the bearing pin 24. Axial recesses 21 in the hub 25 form the vent passage of the base insert 5'. The axial recesses 21 are located eccentrically with respect to a central bearing opening 22 in the hub 25. The hub 25 is connected with a hub or cylindrical extension 46, which extension 46 includes radial labyrinth walls 38, 39. The hub cylindrical extension 46 forms, with the extension 45 of the cover 4', an annular groove 47. The annular groove 47 connects the vent passage formed by the axial recesses 21 with the labyrinth chamber 16 of the cover 4'.

A labyrinth wall 15' of the cover 4' is located in a flow path between the annular groove 47 and the labyrinth chamber 16. The connection or communication between the atmosphere and the labyrinth wall 16 is formed by an annular groove 43 disposed between the labyrinth wall 39 and a cover edge 44.

An annular groove 36, concentrically disposed with respect to the base axis 7—7, is provided in the end wall 32 of the base insert 5' which is located opposite the cover 4', and an annular seal 37 is inserted in the annular groove 36. The space or distance 33 of the end surface 32 with respect to the edge of the cover 4' is less than a space or distance 35 of the end surface 34 of the threaded nut 23 which is opposite the cover 4'. The bearing pin 24 is provided with a threaded bore that originates at its end surface 34.

While I have shown and described several embodiments in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A vent cap for closing and venting an opening of a container for hydraulic operating means located on the ambient-air side, said opening comprising an aperture with edges for connecting the interior of the container with the ambient air, having a lid-shaped part with a peripheral wall and a base-shaped part of the cap, where the base-shaped part of the cap is inserted within the peripheral wall of the lid-shaped part of the cap and has ring-shaped sealing means for the sealing of the opening disposed centrally with respect to a central axis, and where one of the parts of the cap is provided with fastening means for the detachable securing of the fitting position of the vent cap at the opening of the container and both parts of the cap have corresponding central mounting supports for the mutual mounting, with said mounting supports fastening the parts of the cap essentially immovably with respect to one another in the direction of the central axis, characterized in that the lid-shaped part of the cap has a journal located radially on the inside with respect to the central axis, and the base-shaped part of the cap has a hub resting on the journal, with the hub being provided with a central ring-shaped receiving groove contacting said edges which is separated from the fastening means, for said sealing ring means engaging said edges, and both parts of the cap in fitting direction, by means of their journal-hub-mounting, being mounted so that they can be rotated freely with respect to one another.

2. A vent cap according to claim 1, characterized in that the lid-shaped and base-shaped parts include a plurality of labyrinth walls.

3. A vent cap according to claim 2, characterized in that the fluid is a hydraulic operating fluid.

4. A vent cap according to claim 2, characterized in that a plurality of tongues are provided on the base-shaped part on an end thereof opposite the lid-shaped part, means are provided on each of the tongues for axially fixing the vent cap in the vent opening of a container, and in that the tongues are radially compressible with respect to a longitudinally extending axis of the base-shaped part.

5. A vent cap according to claim 4, characterized in that the means for axially fixing the vent cap in the opening includes a barbed tip provided on each of the tongues.

6. A vent cap according to claim 4, characterized in that the tongues are made of a plastic material.

7. A vent cap according to one of claims 1, 2, or 4, characterized in that said seal means includes an annular seal means accommodated in the groove.

8. A vent cap according to claim 7, characterized in that the means for mounting the housing cover on the base insert means includes a bearing pin provided on the housing cover, and a hub provided on the base insert means, and in that the bearing pin is disposed so as to be coaxial with respect to the longitudinal axis of the base insert means.

9. A vent cap according to claim 8, characterized in that the lid-shaped part includes a chamber, and in that the bearing pin includes at least one passageway for communicating the opening means with the chamber thereby enabling a venting of an interior of the container when the cap is installed on the vent opening of the container.

10. A vent cap according to one of claims 1, 2, or 4, characterized in that the means for mounting the lid-shaped part on the base-shaped part includes a bearing pin provided on the lid-shaped part, and a hub provided on the base-shaped part, and in that the bearing pin is disposed so as to be coaxial with respect to a longitudinally extending center axis of the base-shaped part.

11. A vent cap according to claim 10, characterized in that the lid-shaped part includes a chamber, and in that the bearing pin includes at least one passageway for communicating the vent opening means with the chamber thereby enabling a venting of an interior of the container when the vent cap is installed on the opening of the container.

12. A vent cap according to one of claims 1, 2, or 4 characterized in that the base-shaped part includes a plurality of labyrinth walls, and in that means are provided for communicating an interior of the vent cap with the atmosphere when the vent cap is installed on the opening of the container.

13. A vent cap according to one of claims 1, 2, or 4, characterized in that the base-shaped part includes a bead portion, and in that the lid-shaped part includes means for accommodating the bead portion so as to enable an axial mounting of the lid-shaped part on the base-shaped part.

14. A vent cap according to claim 2, characterized in that a vent opening means is disposed eccentrically with respect to a longitudinal center axis of the base-shaped part, means for mounting the lid-shaped part on the base-shaped part includes a threaded nut, means are provided for fixedly mounting the threaded nut to the housing cover, and in that the base-shaped part is provided with a central opening for accommodating the threaded nut.

15. A vent cap according to claim 14, characterized in that the threaded nut is a metal nut.

16. A vent cap according to claim 14, characterized in that means are provided for axially fixing the threaded nut with respect to the lid-shaped part.

17. A vent cap according to claim 16, characterized in that the means for mounting the lid-shaped part on the base-shaped part further includes a bearing pin means provided on the threaded nut at a position disposed opposite the lid-shaped part, and a hub means provided on the base-shaped part, the hub means are adapted to be mounted on the bearing pin.

18. A vent cap according to claim 17, characterized in that the bearing pin includes a free end, and in that an annular bear is provided on the free end of the bearing pin for axially fixing the hub with respect to the threaded nut.

19. A vent cap according to claim 18, characterized in that the hub is made of a plastic material.

20. A vent cap according to one of claims 17, 18, or 19, characterized in that the means for fixedly mounting the threaded nut to the lid-shaped part includes a mounting pin provided on the threaded nut at a position opposite the bearing pin, and in that the lid-shaped part is provided with a recess means for accommodating the mounting pin.

21. A vent cap according to claim 20, characterized in that the lid-shaped part includes a pin-shaped extension, and in that the recess means for accommodating the mounting pin is disposed in the extension.

22. A vent cap according to claim 21, characterized in that the means for fixedly mounting the threaded nut to the lid-shaped part further includes a bead means provided on the threaded nut for non-rotatably mounting the threaded nut in the lid-shaped part.

23. A vent cap according to claim 22, characterized in that the base-shaped part includes an end surface, the threaded nut includes an end surface disposed opposite the lid-shaped part, and in that the end surface of the base-shaped part is disposed at a distance from an end surface of the lid-shaped part which is less than a distance of the end surface of the threaded nut from the end surface of the lid-shaped part, as viewed in a direction of the longitudinal center axis of the base-shaped part.

24. A vent cap according to claim 23, characterized in that an annular groove means is provided in the end surface of the base-shaped part concentric to the longitudinal center axis of the base-shaped part, and in that an annular seal is disposed in the annular groove means.

25. A vent cap according to one of claims 14, 16, 17, or 18, characterized in that the base-shaped part includes an end surface, the threaded nut includes an end surface disposed opposite the lid-shaped part, and in that the end surface of the base-shaped part is disposed at a distance from an end surface of the lid-shaped part which is less than a distance of the end surface of the threaded nut from the end surface of the lid-shaped part, as viewed in a direction of the longitudinal center axis of the base-shaped part.

26. A vent cap according to claim 25, characterized in that an annular groove means is provided in the end surface of the base-shaped part concentric to the longitudinal center axis of the base insert means, and in that an annular seal is disposed in the annular groove means.

27. A vent cap adapted to be mounted on the vent opening of a container for accommodating a fluid, the vent cap including a housing cover, a base insert means for covering the housing cover, and a vent opening means, characterized in that means are provided for rotatably mounting the housing cover on the base insert means including a bearing pin provided on the housing cover, and a hub provided on the base insert means, the base insert means includes a circumferential groove means located outside of the housing cover, an annular seal means is accommodated in the circumferential groove means, the bearing pin is disposed so as to be coaxial with respect to a longitudinal axis of the base insert means, the cover housing includes a chamber, the bearing pin includes at least one passageway for communicating the vent opening with the chamber, the bearing pin further includes a plurality of tongues adapted to be radially compressible with respect to the longitudinal axis of the base insert means under a spring tension, and in that the hub includes stop means cooperable with tongues of the bearing pin for axially fixing the housing cover relative to the base insert means.

28. A vent cap according to claim 27, characterized in that each of the tongues includes tip portions at free ends thereof adapted to engage the stop means of the hub.

29. A vent cap according to claim 27, characterized in that the base insert means further includes a plurality of labyrinth walls, and in that means are provided for communicating a chamber of the vent cap with the atmosphere when the vent cap is installed on the vent opening of the container.

30. A vent cap according to claim 29, characterized in that said means for communicating the chamber with the atmosphere is an annular slot formed between an edge of the housing cover and one of the labyrinth walls of the base insert means.

31. A vent cap according to claim 30, characterized in that the hub further includes an inner bead portion, the bearing pin further includes an annular groove means for accommodating the inner bead portion so as to enable an axial mounting of the hub on the bearing pin.

32. A vent cap adapted to be mounted on a vent opening of a container for accommodating a fluid, the vent cap including a housing cover, a base insert means for covering the housing cover, and a vent opening means, characterized in that means are provided for rotatably mounting the housing cover on the base insert means including a bearing pin provided on the housing cover, and a hub provided on the base insert means, the bearing pin is disposed so as to be coaxial with respect to a longitudinally extending center axis of the base insert means, the cover housing includes a chamber, the bearin pin includes at least one passageway for communicating the vent opening means with the chamber, the bearing pin further includes a plurality of tongues adapted to be radially compressible with respect to the longitudinally extending center axis of the base insert means under a spring tension, and in that the hub includes stop means cooperable with tongues of the bearing pin for axially fixing the housing cover relative to the base insert means.

33. A vent cap adapted to be mounted on a vent opening of a container for accommodating a fluid, the vent cap comprising a housing cover, a base insert means for covering the housing cover, and a vent opening means, means are provided for rotatably mounting the housing cover on the base insert means including a bearing pin provided on the housing cover, and a hub provided on the base insert means, the bearing pin is disposed so as to be coaxial with respect to a longitudinally extending center axis of the base insert means, the cover housing includes a chamber, the bearing pin includes at least one passageway for communicating the vent opening means with the chamber, the bearing pin further includes a plurality of tongues adapted to be radially compressible with respect to the longitudinally extending center axis of the base insert means under a spring tension, and the hub includes stop means cooperable with tongues of the bearing pin for axially fixing the housing cover relative to the base insert means, characterized in that the base insert means includes a plurality of labyrinth walls, and in that means are provided for communicating an interior of the vent cap with the atmosphere when the vent cap is installed on the vent opening of the container.

34. A vent cap according to claim 33, characterized in that the housing cover includes a plurality of labyrinth walls.

35. A vent cap according to one of claims 33 or 34, characterized in that a plurality of tongues are provided on the base insert means on an end thereof opposite the housing cover, means are provided on each of the tongues for axially fixing the vent cap in the vent opening of the container, and in that the tongues are radially compressible with respect to a longitudinally extending axis of the base insert means.

36. A vent cap adapted to be mounted on a vent opening of a container for accommodating a fluid, the vent cap comprising a housing cover, a base insert means for covering the housing cover, a vent opening means, means are provided on the base insert means, the bearing pin is disposed so as to be coaxial with respect to a longitudinally extending center axis of the base insert means, the cover housing includes a chamber, the bearing pin includes at least one passageway for communicating the vent opening means with the chamber, the bearing pin further includes a plurality of tongues adapted to be radially compressible with respect to the longitudinally extending center axis of the base insert means under a spring tension, and the hub includes stop means cooperable with tongues of the bearing pin for axially fixing the housing cover relative to the base insert means, characterized in that the base insert means includes a bead portion, and in that the housing cover includes means for accommodating the bead portion so as to enable an axial mounting of the housing cover on the base insert means.

* * * * *